US008564396B2

(12) United States Patent
Pan

(10) Patent No.: US 8,564,396 B2
(45) Date of Patent: Oct. 22, 2013

(54) LAMINAR TRANSFORMER HAVING DOUBLE-FACE SECONDARY WINDING

(75) Inventor: Cheng-Yu Pan, New Taipei (TW)

(73) Assignee: Yujing Technology Co., Ltd, New Taipei (TW)

( * ) Notice: Subject to any disclaimer, the term of this patent is extended or adjusted under 35 U.S.C. 154(b) by 0 days.

(21) Appl. No.: 13/344,522

(22) Filed: Jan. 5, 2012

(65) Prior Publication Data

US 2012/0182113 A1 Jul. 19, 2012

(30) Foreign Application Priority Data

Jan. 14, 2011 (TW) ..... 100200914 U

(51) Int. Cl.

| | |
|---|---|
| ***H01F 27/28*** | (2006.01) |
| ***H01F 27/29*** | (2006.01) |
| ***H01F 27/30*** | (2006.01) |
| ***H01F 27/04*** | (2006.01) |

(52) U.S. Cl.

USPC ..... 336/222; 336/192; 336/198; 336/182; 336/220; 336/221; 336/232

(58) Field of Classification Search

USPC ..... 336/192, 198, 220–222, 232, 182

See application file for complete search history.

(56) References Cited

U.S. PATENT DOCUMENTS

| | | | | |
|---|---|---|---|---|
| 4,460,884 | A * | 7/1984 | Post et al. | 336/73 |
| 7,091,817 | B2 * | 8/2006 | Peck et al. | 336/208 |
| 7,701,316 | B2 * | 4/2010 | Teng et al. | 336/131 |
| 8,054,152 | B2 * | 11/2011 | Tseng et al. | 336/192 |
| 2008/0284551 | A1 * | 11/2008 | Chen et al. | 336/182 |
| 2009/0237195 | A1 * | 9/2009 | Zeng et al. | 336/196 |
| 2010/0026437 | A1 * | 2/2010 | Lin et al. | 336/192 |
| 2010/0265029 | A1 * | 10/2010 | Xiong et al. | 336/232 |
| 2011/0090037 | A1 * | 4/2011 | Tsai et al. | 336/220 |
| 2011/0193887 | A1 * | 8/2011 | Lee et al. | 345/690 |
| 2012/0075049 | A1 * | 3/2012 | Horng | 336/198 |

* cited by examiner

*Primary Examiner* — Elvin G Enad
*Assistant Examiner* — Kazi Hossain
(74) *Attorney, Agent, or Firm* — Lowe Hauptman & Ham, LLP

(57) ABSTRACT

A laminar transformer having double-face secondary winding includes a primary winding part and a secondary winding part. The primary winding part further includes an isolating body seat and a plurality of coil sets. The secondary winding part further includes two plate-body set, each being positioned in the containing channel has a plurality of plate bodies and a plurality of insulating bodies. Each of the plate bodies has an opening for containing the central column and a guided channel that being positioned on a side of the opening has on both side thereof a pole lead respectively. The insulating bodies being a ring-shaped structure and being positioned in-between the plate bodies has a through hole for containing the central column. The plurality of plate bodies are laminated alternately and positioned in the central column making each of the plate-body sets form the one with four pole leads.

9 Claims, 5 Drawing Sheets

LAMINAR TRANSFORMER HAVING DOUBLE-FACE SECONDARY WINDING

BACKGROUND OF THE INVENTION

1. Field of the Invention

The invention relates to a laminar transformer having double-face secondary winding, and more particularly, to a laminar transformer having double-face secondary winding by using a plurality of laminar sheets positioned in laminar type on the two side surfaces of the primary winding.

2. Description of the Prior Art

Since the high technology in the field of microelectronics advances with giant stride, the relevant manufacturing process changes with each passing day, and the electronic products, having deepened into each family and all walks of life, become indispensable part in modern life.

In general, the input voltage is either 110V or 220V in our daily life. This kind of high voltage oftentimes would damage the electronic products. Since all the electronic relevant products need an output voltage to perform operation, we all need to use a transformer to lower the high voltage while the electronic products are used.

A common transformer on the market all has a primary winding part and a secondary winding part and both of them have coils wound by a plurality of twisted enamel wires. The primary winding part has a plurality of connecting legs soldered on a substrate by copper material. On the other hand, the secondary winding part is loaded by low voltage but high current, its enamel wires are relatively large in diameter as comparing with those of the high voltage side part, thereby, the loss due to Eddy current is relatively high too. In addition, the coils on the high voltage side part occupy a fairly large space that leads to relatively bigger overall size of the transformer.

Therefore, just how to design a secondary winding part to save the space and diminish the loss due to eddy current has become an urgent issue to seek for a resolving and improving program in the industry.

SUMMARY OF THE INVENTION

In light of the above-mentioned disadvantages of the prior art, the invention provides a laminar transformer having double-face secondary winding that is capable of overcoming the shortcomings of the prior art, satisfying the requirements of the industry, as well as improving the competitiveness in the market. It aims to ameliorate at least some of the disadvantages of the prior art or to provide a useful alternative.

The primary objective of the invention is to provide a laminar transformer having double-face secondary winding by making use of the plurality of plate bodies that are alternately laminated to replace the coil with enameled wires of the prior art, thereby, the laminar transformer having double-face secondary winding of the invention is capable of achieving the efficacies of saving the space on the secondary winding part and diminishing the loss resulted from the eddy current.

To achieve the above-mentioned objective, a laminar transformer having double-face secondary winding includes a primary winding part and a secondary winding part. The primary winding part further includes an isolating body seat and a plurality of coil sets where the isolating body seat has a plurality of isolating channels, a plurality of connecting legs, and, at both end thereof, a containing channel that further has a central column. The plurality of coil sets is corresponding and wound around the plurality of isolating channels. The secondary winding part further includes two plate-body set, each being positioned in the containing channel has a plurality of plate bodies and a plurality of insulating bodies. Each of the plate bodies has an opening for containing the central column and a guided channel that being positioned on a side of the opening has on both sides thereof a pole lead respectively. The insulating bodies being a ring-shaped structure and being positioned in-between the plate bodies has a through hole for containing the central column. The plurality of plate bodies are laminated alternately and positioned in the central column making each of the plate-body sets form the one with four pole leads.

The accomplishment of this and other objectives of the invention will become apparent from the following description and its accompanying drawings of which:

DETAILED DESCRIPTION OF THE PREFERRED EMBODIMENT

Figure 1:
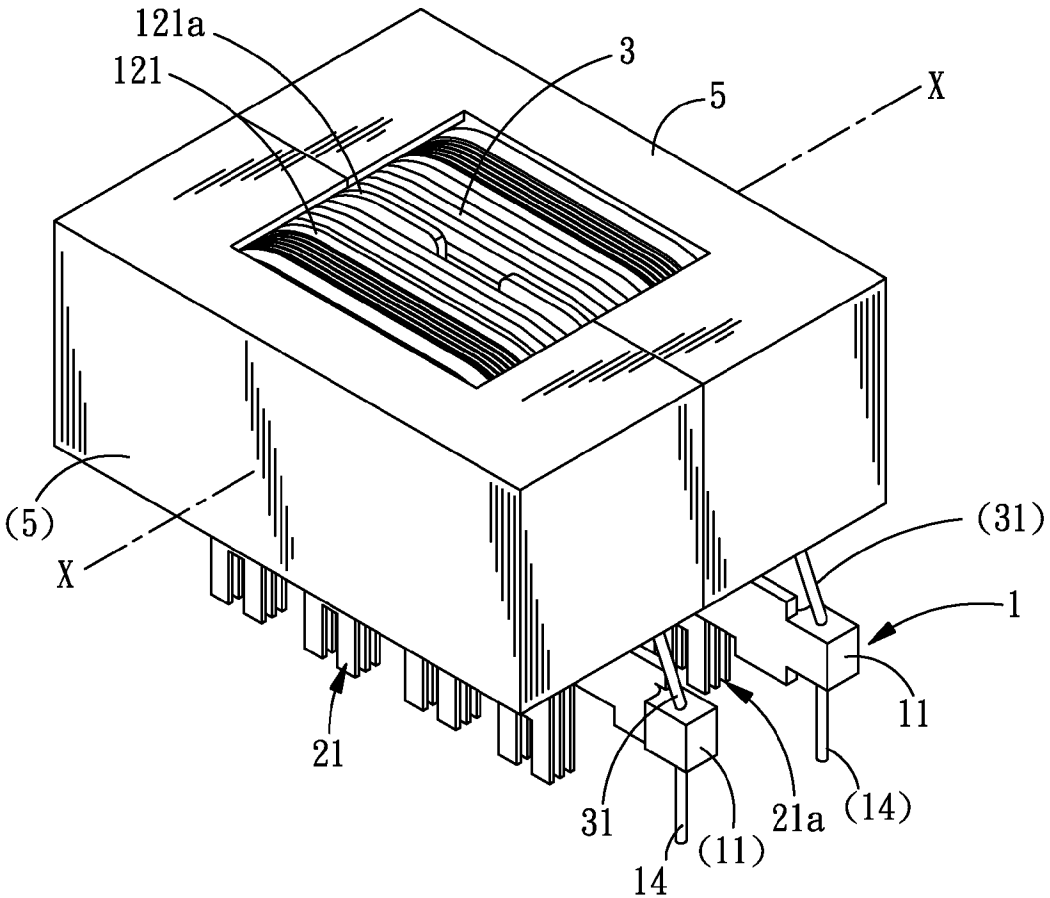
FIG. 1 is a top isometric view of an assembled structure a laminar transformer having double-face secondary winding of a preferred embodiment of the invention.
Figure 2:
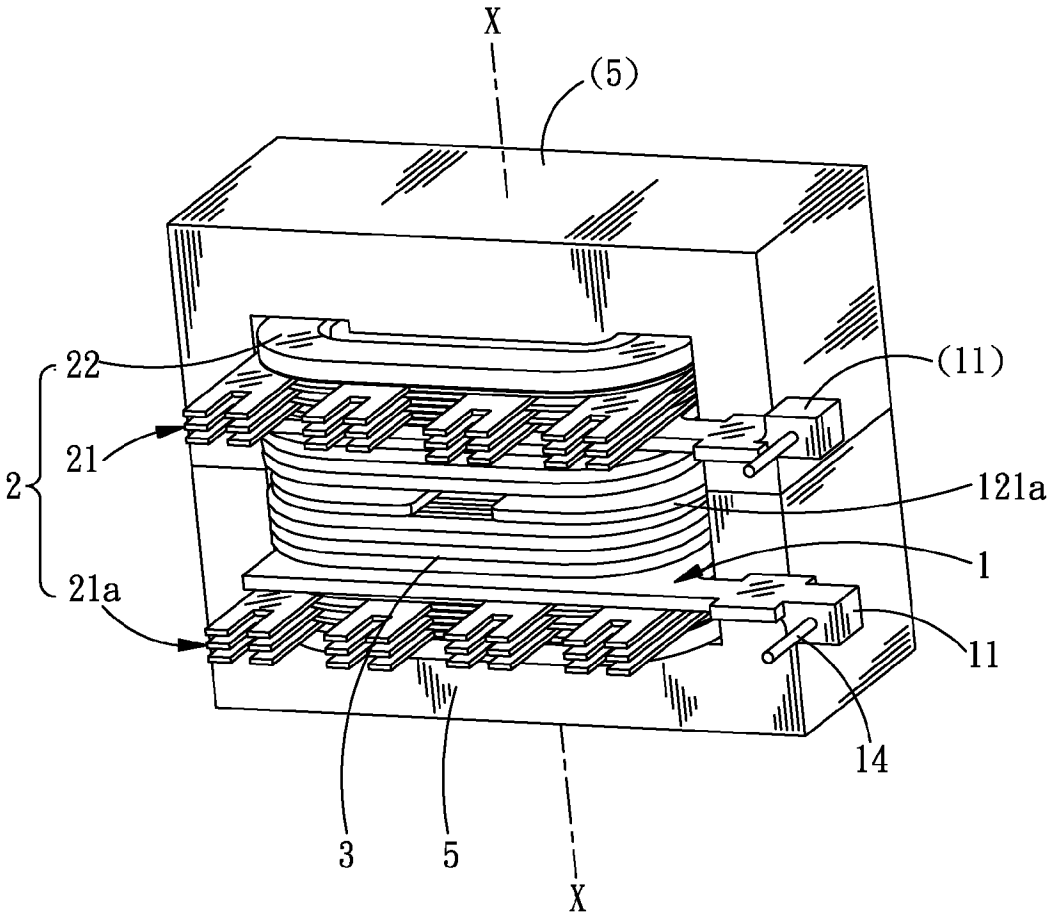
FIG. 2 is a bottom isometric view of an assembled structure a laminar transformer having double-face secondary winding of a preferred embodiment of the invention.
Figure 3:
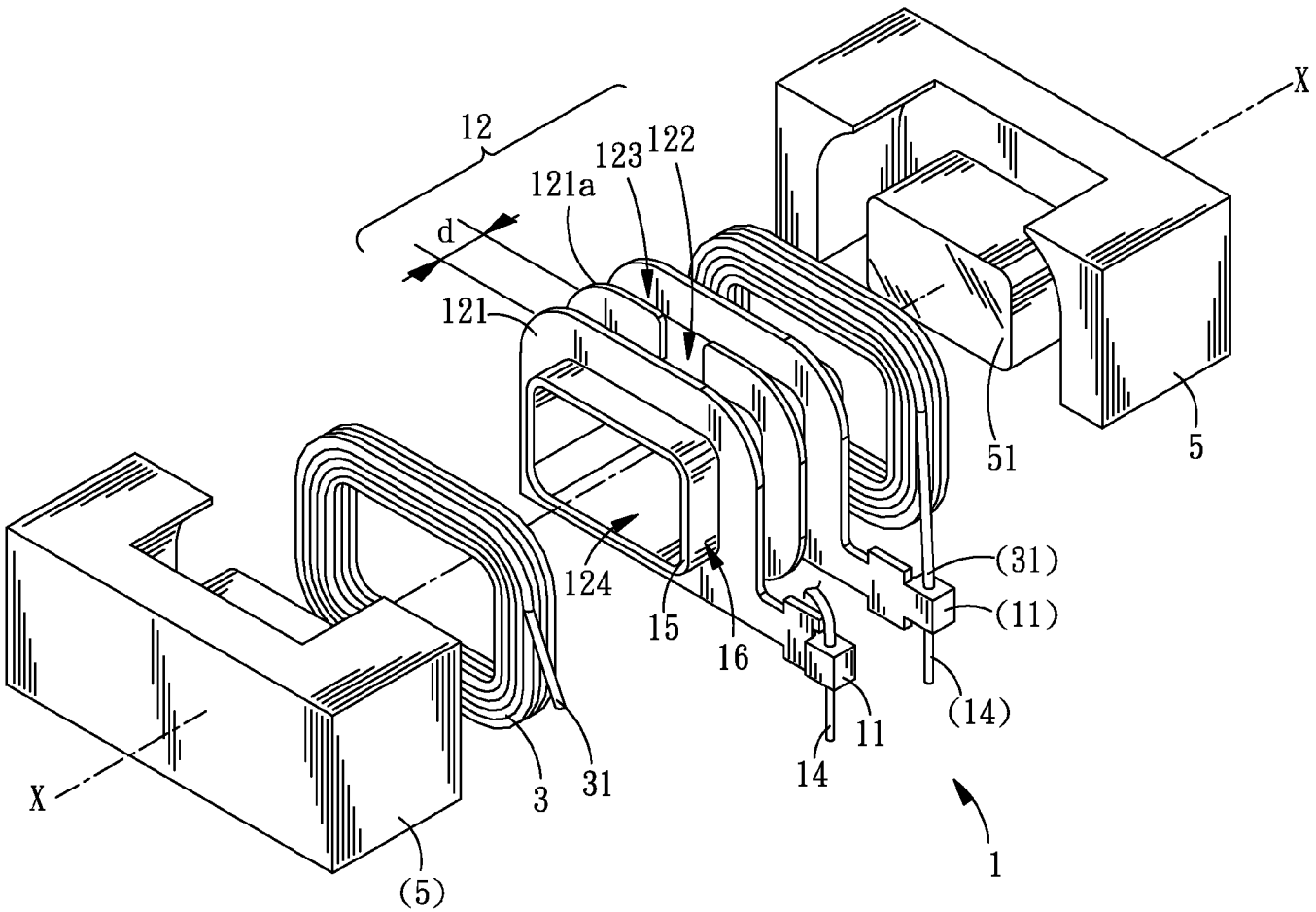
FIG. 3 is an exploded view of the structure of a laminar transformer having double-face secondary winding of a preferred embodiment of the invention.

FIG. 1 through FIG. 5 are a top isometric view and a bottom isometric view of an assembled structure, an exploded view of the structure, an exploded view of the structure of the primary winding, and an exploded view of the structure of the secondary winding of a laminar transformer having double-face secondary winding of a preferred embodiment of the invention. As shown in FIG. 1 through FIG. 5, the laminar transformer having double-face secondary winding of the invention includes a primary winding part (1), a secondary winding part (2), and an iron core (5). The primary winding part (1) possesses an isolating body seat (12), and a plurality of coil sets (3) where the isolating body seat (12) being a hollow column-shaped structure has a penetrating hole (124) that communicates through both ends thereof. Moreover, as shown in FIG. 3, in a preferred embodiment of the invention, the isolating body seat (12) is made of electrically non-conductive material and is having a plurality of isolating bodies (121) on the surface and on their periphery thereof together with a plurality of connecting legs (14) extended therefrom and secured by penetrating through a connecting-leg seat (11). What is more, a containing channel (16) that further possesses a central column body (15) is provided at both ends of the isolating body seat (12) respectively.

The isolating body seat (12) is separated by a plurality of isolating bodies (121) to form a plurality of isolating channels (123). At least a slot opening (122) is provided on each of the isolating bodies (121) that are positioned between and are communicated through the two isolating channels (123). As all the isolating bodies (121), (121*a*) are substantially parallel, there exists substantially equal spaces of a distance "d".

As shown in FIG. 3, the coil set (3), being wound around the isolator seat (12), is formed by stranding a plurality of enameled wires. Moreover, a plurality of coil sets (3) are positioned on and corresponding to the plurality of isolating channels (123). What is more, any one of the coil sets (3) is capable of connecting to the other coil set (3) through the slot opening (122). A plurality of coil terminals (31), being plated with Tin and connected to the connecting legs (14), is formed at the end of each of the coil sets (3). The laminar transformer having double-face secondary winding of the invention is capable of making use of a plurality of connecting legs (14) to connect to a substrate (not shown in the FIG.) by copper brazing.

Figure 4:
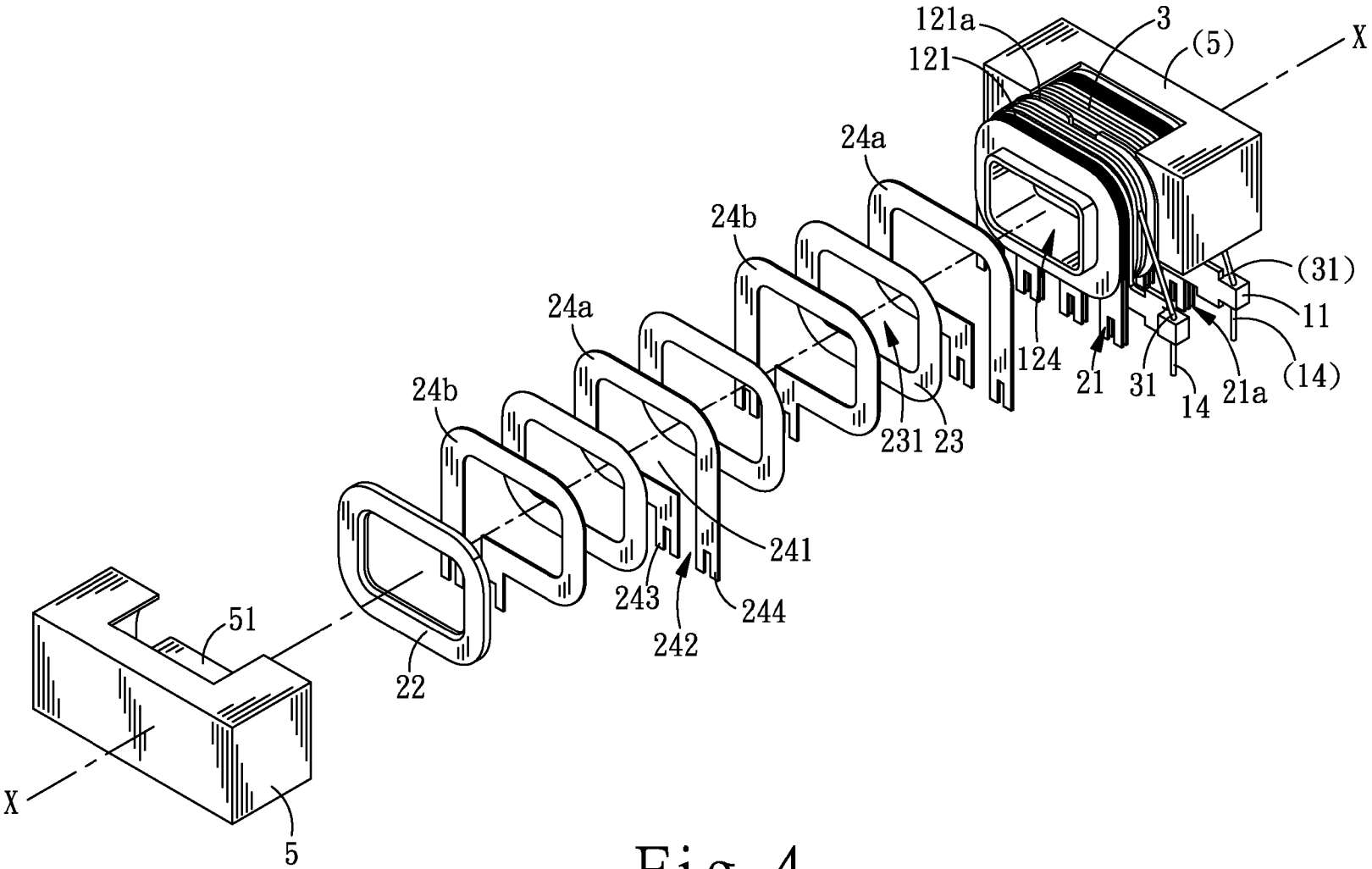
FIG. 4 is an exploded view of the structure of the primary winding of a laminar transformer having double-face secondary winding of a preferred embodiment of the invention.
Figure 5:
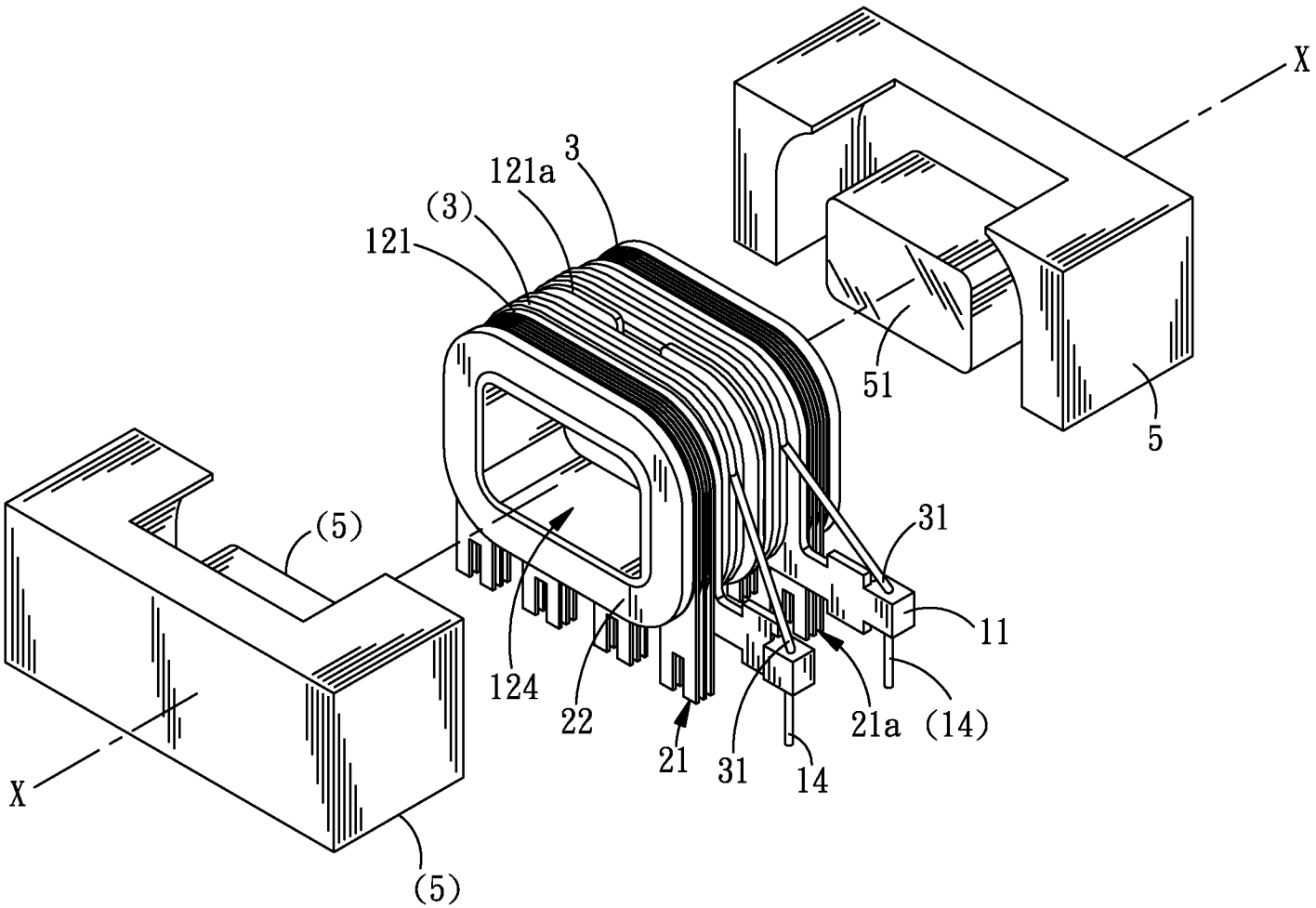
FIG. 5 is an exploded view of the structure of the secondary winding of a laminar transformer having double-face secondary winding of a preferred embodiment of the invention.

As shown in FIG. 5 and FIG. 4, the secondary winding part (2) of the invention includes two plate-body sets (21), (21*a*). Each of the plate-body sets (21), (21*a*) is positioned in the containing channel (16) (see FIG. 3) and has a plurality of plate bodies (24), (24*a*) as well as a plurality of insulating bodies (23). In a preferred embodiment of the invention, each of the plate bodies (24*a*), (24*b*), being a Tin-plated copper sheet and being integrally formed, possesses an opening (241) for containing the central column body (15) (see FIG. 3), a guided channel (242), and two pole leads (243) which are furnished on the two sides of the guided channel (242), respectively. In a preferred embodiment of the invention, the end of the pole leads (243) is split into two by having a slot opening (244) between them. These split pole leads (243) are capable of providing connection for various circuit layouts. Among the plurality of plate bodies (24*a*) (24*b*), having their two pole leads (243) pointing downward, the plate bodies (24*a*) has these two pole leads (243) off-set from the central axis x-x on one side while the plate bodies (24*b*) has these two pole leads (243) off-set from the central axis x-x on the other side.

In a preferred embodiment of the invention, as shown in FIG. 4, the plurality of plate bodies (24*a*), (24*b*) are arranged in sequential order from one end to the other end along the central column (15) and having the plate bodies (24*a*) alternate with the plate bodies (24*b*) with the insulating bodies (23), which is a ring-shaped structure, arranged in-between the plate bodies (24*a*) and the plate bodies (24*b*) in sequential order along the central column (15) wherein the insulating bodies (23) being made of electrically non-conductive material are capable of protecting the plate bodies (24*a*),(24*b*) against short circuit. In this way, each of the plate-body sets (21) (21*a*) becomes the one having four pole leads (243) to provide connection for various circuit layouts. Moreover, as shown in FIG. 3, each ends of the isolating body seat (12) further possesses a securing part (22) that being connected to the central column (15) and being made of electrically non-conductive material is capable of protecting the plate bodies (24*a*), (24*b*) against short circuit and is having the positioning efficacy. What is more, the laminar transformer having double-face secondary winding in a preferred embodiment of the invention further includes an iron core seat (5) that has an iron core (51) positioned in the penetrating holes (124). Therefore, by making use of the plurality of plate bodies (24*a*), (24*b*) that are alternately laminated to replace the coil with enameled wires of the prior art, the laminar transformer having double-face secondary winding of the invention is capable of achieving the efficacies of saving the space on the secondary winding part (2) and diminishing the loss resulted from the eddy current.

In a conclusion, the laminar transformer having double-face secondary winding of the invention is capable of substantially resolving the demerits of the prior art, satisfying the requirements and improving the competitiveness of the industry in the field, thereby, is having the patentability of having the non-obviousness subject matter and the applicability in the industry in the field.

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. A laminar transformer having a double-face secondary winding, comprising:

a primary winding part comprising:

an isolating body seat having:

a plurality of isolating channels, a plurality of connecting legs, and a containing channel at each of two ends of the isolating body seat, wherein the containing channel further has a central column; and a plurality of coil sets wound around the isolating body seat and positioned in and corresponding to the plurality of isolating channels; and a secondary winding part comprising two plate-body sets each positioned in the corresponding containing channel, and each of the plate-body sets comprising:

a plurality of first and second plate bodies each having an opening for containing the central column, and a guided channel, wherein the guide channel of each first plate body is positioned on a first side of the opening, the guide channel of each second plate body is positioned on a second side of the opening, the guided channel has a pole lead on each side thereof, and an end of the pole lead further has a slot opening, and the plurality of first and second plate bodies are arranged in sequential order along the central column and the first plate bodies alternate with the second plate bodies; and a plurality of insulating bodies each being a ring-shaped structure, wherein the insulating bodies are arranged in-between the first plate bodies and the second plate bodies in sequential order along the central column, and each of the insulating bodies has a through hole for containing the central column;

wherein each of the plate-body sets is formed made with four pole leads.

2. The laminar transformer as claimed in claim 1, wherein the plate bodies are tin-plated copper sheets.

3. The laminar transformer as claimed in claim 1, wherein the isolating body seat is made of electrically non-conductive material.

4. The laminar transformer as claimed in claim 1, wherein the isolating body seat further has at least an open channel that is positioned between and communicated through the isolating channels.

5. The laminar transformer as claimed in claim 1, wherein the insulating bodies are made of electrically non-conductive material.

6. The laminar transformer as claimed in claim 1, wherein each of the coil sets further has a coil terminal that is connected to the corresponding connecting leg.

7. The laminar transformer as claimed in claim 1, wherein each of the two ends of the isolating body seat further has a securing part that is connected to the central column.

8. The laminar transformer as claimed in claim 7, wherein the securing part is made of electrically non-conductive material.

9. The laminar transformer as claimed in claim 1, wherein the laminar transformer further has an iron core seat that has an iron core positioned in one of penetrating holes, and the penetrating holes are positioned at the central column and communicated through the two ends of the isolating body seat.

* * * * *